US008091367B2

(12) United States Patent
Alkabie

(10) Patent No.: US 8,091,367 B2
(45) Date of Patent: Jan. 10, 2012

(54) COMBUSTOR WITH IMPROVED COOLING HOLES ARRANGEMENT

(75) Inventor: Hisham Alkabie, Oakville (CA)

(73) Assignee: Pratt & Whitney Canada Corp., Longueuil (CA)

( * ) Notice: Subject to any disclaimer, the term of this patent is extended or adjusted under 35 U.S.C. 154(b) by 762 days.

(21) Appl. No.: 12/239,218

(22) Filed: Sep. 26, 2008

(65) Prior Publication Data

US 2010/0077763 A1 Apr. 1, 2010

(51) Int. Cl.
*F02C 1/00* (2006.01)
*F02G 3/00* (2006.01)

(52) U.S. Cl. ..... 60/752; 60/754

(58) Field of Classification Search ..... 60/752–760, 60/804

See application file for complete search history.

(56) References Cited

U.S. PATENT DOCUMENTS

| | | | | |
|---|---|---|---|---|
| 4,244,178 | A | 1/1981 | Herman et al. | |
| 4,733,538 | A * | 3/1988 | Vdoviak et al. | 60/752 |
| 5,129,231 | A | 7/1992 | Becker et al. | |
| 5,233,828 | A | 8/1993 | Napoli | |
| 5,241,827 | A | 9/1993 | Lampes | |
| 5,279,127 | A | 1/1994 | Napoli | |
| 5,307,637 | A | 5/1994 | Stickles et al. | |
| 5,357,745 | A | 10/1994 | Probert | |
| 5,590,531 | A | 1/1997 | Desaulty et al. | |
| 5,758,504 | A | 6/1998 | Abreu et al. | |
| 5,775,108 | A * | 7/1998 | Ansart et al. | 60/752 |
| 6,079,199 | A | 6/2000 | McCaldon et al. | |
| 6,205,789 | B1 | 3/2001 | Patterson et al. | |
| 6,427,446 | B1 | 8/2002 | Kraft et al. | |
| 6,434,821 | B1 * | 8/2002 | Nelson et al. | 29/888.01 |
| 6,474,070 | B1 * | 11/2002 | Danis et al. | 60/739 |
| 6,513,331 | B1 | 2/2003 | Brown et al. | |
| 6,655,149 | B2 * | 12/2003 | Farmer et al. | 60/754 |
| 6,675,587 | B2 * | 1/2004 | Graves et al. | 60/804 |
| 6,868,675 | B1 * | 3/2005 | Kuhn et al. | 60/772 |
| 7,036,316 | B2 * | 5/2006 | Howell et al. | 60/772 |
| 7,124,588 | B2 | 10/2006 | Gerendas et al. | |
| 7,260,936 | B2 | 8/2007 | Patel et al. | |
| 7,546,737 | B2 * | 6/2009 | Schumacher et al. | 60/754 |
| 7,748,222 | B2 * | 7/2010 | Bernier et al. | 60/754 |
| 7,900,457 | B2 * | 3/2011 | Patterson et al. | 60/752 |
| 7,926,284 | B2 * | 4/2011 | Zupanc et al. | 60/754 |
| 7,942,005 | B2 * | 5/2011 | Bessagnet et al. | 60/752 |
| 7,954,325 | B2 * | 6/2011 | Burd et al. | 60/752 |
| 2006/0037323 | A1 | 2/2006 | Reynolds et al. | |
| 2006/0196188 | A1 | 9/2006 | Burd et al. | |
| 2007/0130953 | A1 | 6/2007 | Burd et al. | |
| 2007/0169484 | A1 | 7/2007 | Schumacher et al. | |

* cited by examiner

*Primary Examiner* — William Rodriguez
(74) *Attorney, Agent, or Firm* — Norton Rose OR LLP

(57) ABSTRACT

A gas turbine engine combustor liner with at least one of the inner and outer liners that is effusion cooled and has a row of groups of circumferentially spaced apart dilution holes defined therethrough. Each group is located within a respective zone of the combustor liner defined by an overlap of adjacent conical sections corresponding to the sprays of adjacent fuel nozzles.

21 Claims, 4 Drawing Sheets

COMBUSTOR WITH IMPROVED COOLING HOLES ARRANGEMENT

TECHNICAL FIELD

The field relates generally to a combustor of a gas turbine engine and, more particularly, to combustor cooling.

BACKGROUND OF THE ART

Cooling of combustor walls is typically achieved by directing cooling air through holes in the combustor wall to provide effusion and/or film cooling. These holes may be provided as effusion holes or diffusion holes formed directly through a sheet metal liner of the combustor walls. Opportunities for improvement are continuously sought, however, to provide improved cooling, better mixing of the cooling air, better fuel efficiency and improved performance, all while reducing costs.

SUMMARY

In one aspect, provided is a gas turbine engine combustor liner comprising a dome having a series of circumferentially spaced apart fuel nozzle receiving holes defined therethrough, the liner having an inner liner and an outer liner defining a combustion chamber therebetween, the combustion chamber having a plurality of overlap zones corresponding to an overlap of adjacent fuel cones centered on a respective receiving hole and corresponding to a fuel/air spray cone produced by a fuel nozzle received in the receiving holes, at least one of the inner and outer liners being effusion cooled and having a row of spaced apart dilution holes defined therethrough, the dilution holes being grouped in pairs of adjacent holes, the spacing between adjacent pairs being greater than a spacing between the adjacent holes of a pair, each pair being entirely located within a respective overlap zones.

In another aspect, provided is a gas turbine engine combustor comprising a dome end having receiving holes defined therethrough, an inner liner wall and an outer liner wall extending from the dome end and defining a combustion chamber therebetween, a fuel nozzle received in each of the receiving holes for producing a conical spray within the combustion chamber, at least one of the outer liner wall and the inner liner wall being effusion cooled and including a circumferential row of dilution holes defined therethrough, the dilution holes of the row being disposed in groups with the row being free of dilution holes between adjacent ones of the groups, each group being entirely located between adjacent ones of the receiving holes within an overlap zone of the conical sprays of the fuel nozzles.

Further details will be apparent from the detailed description and figures included below.

DESCRIPTION OF THE DRAWINGS

Reference is now made to the accompanying figures in which.

DETAILED DESCRIPTION

Figure 1:
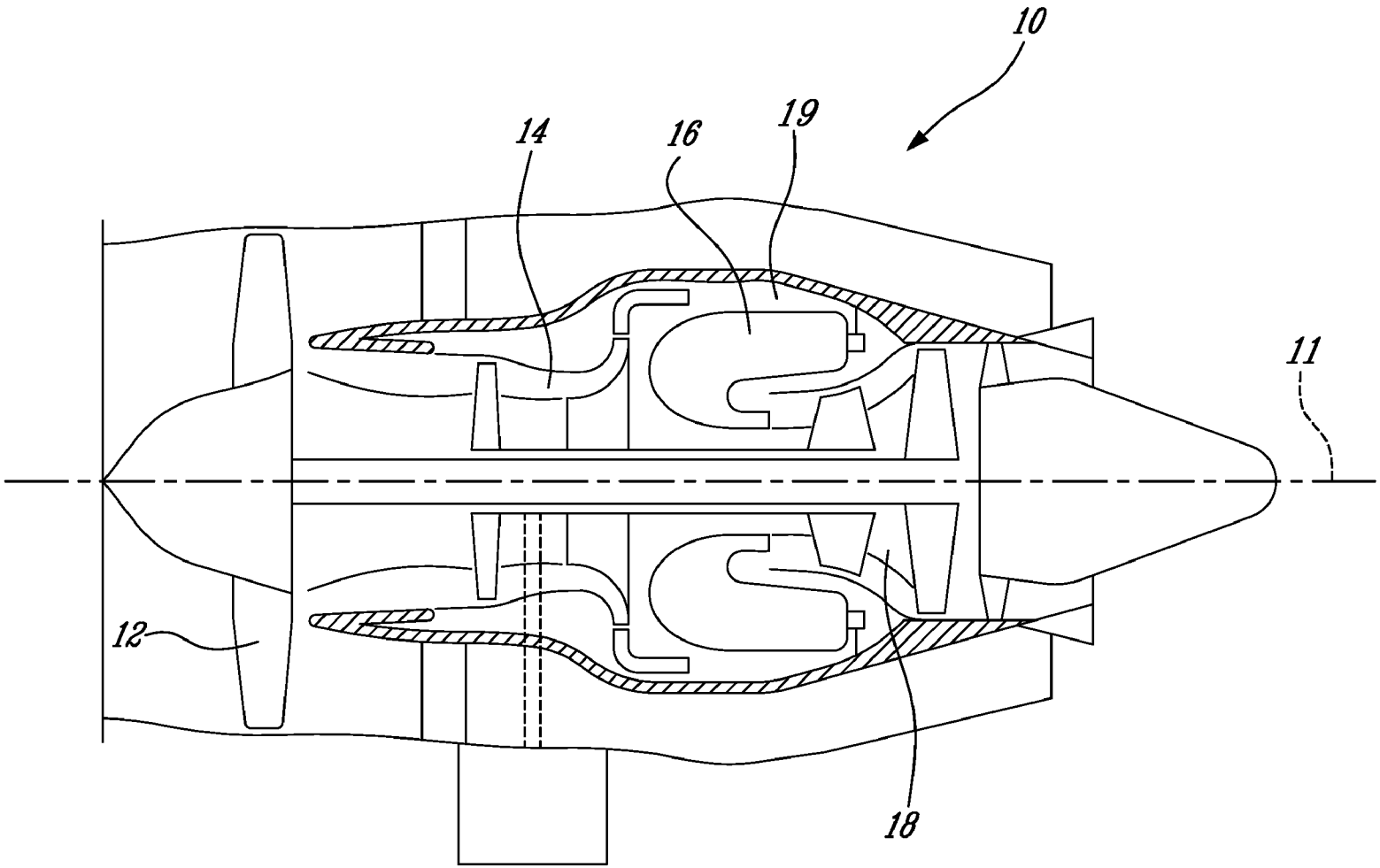
FIG. 1 is a schematic partial cross-section of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Still referring to FIG. 1, the combustor 16 is housed in a plenum 19 supplied with compressed air from the compressor 14. The combustor 16 is preferably, but not necessarily, an annular reverse flow combustor.

Figure 2:
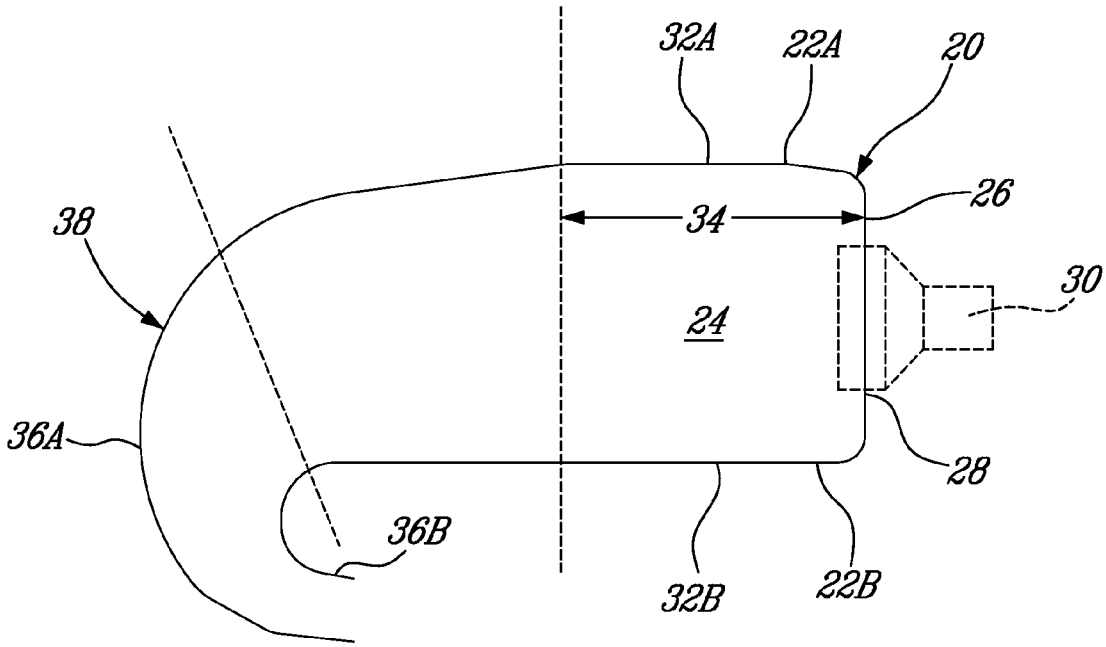
FIG. 2 is a schematic partial cross-section of a combustor which can be used in a gas turbine engine such as shown in FIG. 1.

Referring to FIG. 2, the combustor 16 comprises generally a liner 20 including an outer liner 22A and an inner liner 22B defining a combustion chamber 24 therebetween. The outer and inner liners 22A,B comprise panels of a dome portion or end 26 of the combustor liner 20 at their upstream end, in which a plurality of nozzle receiving holes 28 (only one of which being shown) are defined and preferably equally circumferentially spaced around the annular dome portion 26. Each nozzle receiving hole 28 receives a fuel nozzle 30 therein, schematically depicted in the FIG. 2, for injection of a fuel-air mixture into the combustion chamber 24.

The outer and inner liners 22A,B each include an annular liner wall 32A,B which extends downstream from, and circumscribes, the respective panel of the dome portion 26. The outer and inner liners 22A,B define a primary zone or region 34 of the combustion chamber 24 at the upstream end thereof, where the fuel/air mixture provided by the fuel nozzles is ignited.

The outer liner 22A also includes a long exit duct portion 36A at its downstream end, while the inner liner 22B includes a short exit duct portion 36B at its downstream end. The exit ducts portions 36A,B together define a combustor exit 38 for communicating with the downstream turbine section 18.

The combustor liner 20 is preferably, although not necessarily, constructed from sheet metal. The terms upstream and downstream as used herein are intended generally to correspond to direction of gas from within the combustion chamber 24, namely generally flowing from the dome end 26 to the combustor exit 38. The terms "axially" and "circumferentially" as used herein are intended generally to correspond, respectively, to axial and circumferential directions of the combustor 16, and relative to the main engine axis 11 (see FIG. 1).

A plurality of cooling holes, including both diffusion and effusion holes, are provided in the liner of the combustor 16, as will be described in more detail further below. The cooling holes may be provided by any suitable means, such as for example laser drilling or a punching machine with appropriate hole size elongation tolerances.

In use, compressed air from the gas turbine engine's compressor 14 enters the plenum 19, then circulates around the combustor 16 and eventually enters the combustion chamber 24 through the cooling holes defined in the liner 20 thereof, following which some of the compressed air is mixed with fuel for combustion. Combustion gases are exhausted through the combustor exit 38 to the downstream turbine section 18.

While the combustor 16 is depicted and described herein with particular reference to the cooling holes, it is to be understood that compressed air from the plenum also enters the combustion chamber via other apertures in the combustor liner 20, such as combustion air flow apertures, including openings surrounding the fuel nozzles 30 and fuel nozzle air flow passages, for example, as well as a plurality of other cooling apertures (not shown) which may be provided throughout the liner 20 for effusion/film cooling of the outer and inner liners 22A,B. Therefore, a variety of other apertures not depicted in the Figures may be provided in the liner 20 for cooling purposes and/or for injecting combustion air into the combustion chamber 24. While compressed air which enters the combustion chamber 24, particularly through and around the fuel nozzles 30, is mixed with fuel and ignited for combustion, some air which is fed into the combustion chamber 24 is preferably not ignited and instead provides air flow to effusion cool the liner 20.

Figure 3A:
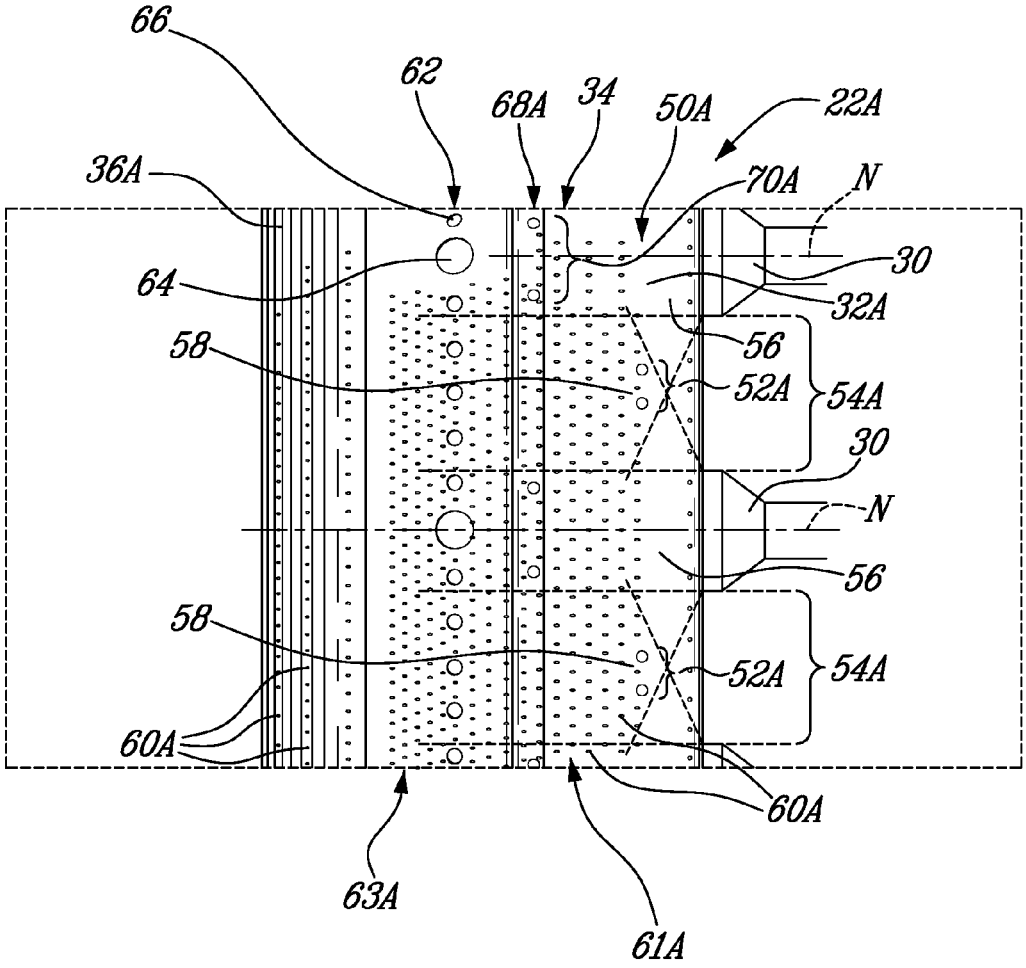
FIG. 3A is a schematic side view of an outer liner of the combustor of FIG. 2.
Figure 3B:
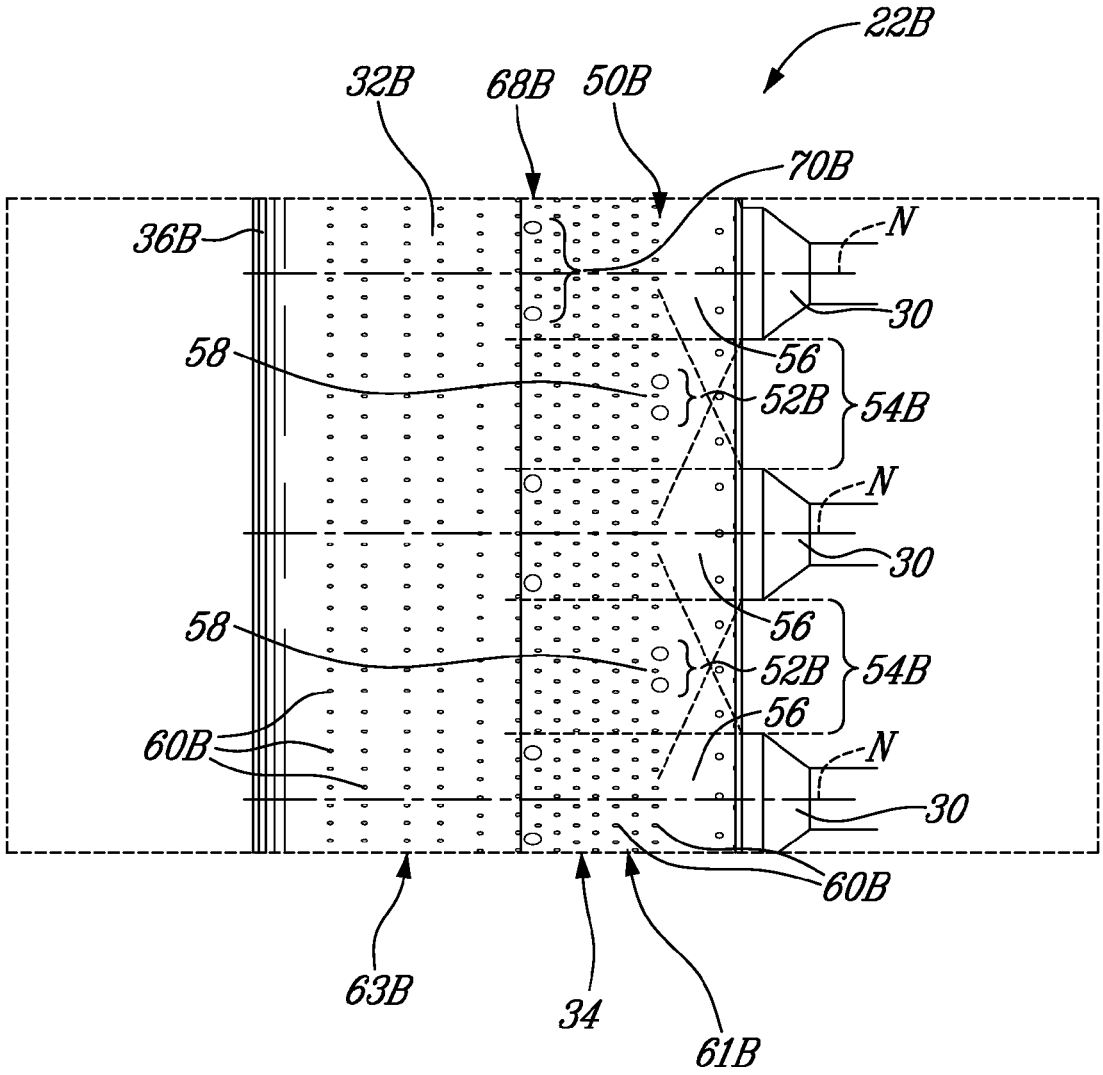
FIG. 3B is a schematic side view of an inner liner of the combustor of FIG. 2.

Referring to FIGS. 3A-3B, the outer and inner liners 22A,B each include a first row 50A,B of dilution holes defined therethrough. The dilution holes are arranged in circumferentially spaced apart groups, which in the embodiment shown include pairs 52A,B, with adjacent holes from adjacent pairs being spaced apart a greater distance than that between the holes of a same pair. Each pair 52A,B of dilution hole is entirely located in a corresponding sector 54A,B of the liner which extends circumferentially between the closest points on the perimeter of adjacent ones of the fuel nozzle receiving holes 28 and which extends axially across the primary region 34. The liners 22A,B are free of dilution holes between the pairs 52A,B along the circumference defined by the first row 50A,B.

A conical section 56 of the combustion chamber 24 can be defined from each of the nozzle receiving holes 28, corresponding to the conical fuel/air spray of each of the fuel nozzles received therein. The conical fuel/air sprays provided by adjacent fuel nozzles 30 produce a rich fuel/air ratio zone 58 where the conical sections 56 overlap. Each pair of dilution holes 52A,B is defined in proximity of the dome portion 26 within a respective one of these overlap zones 58. As such, the pairs 52A,B of dilution holes allow for the reduction of the fuel/air ratio in these zones 58, improving the circumferential uniformity of the fuel/air ratio within the primary region 34. The axial position of the pairs 52A,B of dilution holes and their size is preferably selected to obtain a fuel/air ratio between adjacent fuel nozzles 30 as close as possible to that in front of each fuel nozzle 30, i.e. to maximise the circumferential uniformity of the fuel/air ratio.

In a particular embodiment, the distance between adjacent holes of adjacent pairs 52A,B is at least 3.25 and particularly approximately 7.5 times greater than that between holes of a same pair 52A,B.

Although in the embodiment shown both the outer and inner liners 22A,B include the pairs 52A,B of dilution holes described above, in an alternate embodiment, only one of the outer and inner liners 22A,B includes such pairs 52A,B of dilution holes.

Still referring to FIGS. 3A-3B, the outer and inner liners 22A,B also have a series of effusion holes 60A,B defined therethrough. Effusion holes 60A,B are provided in first and second annular bands or regions defined circumferentially around the combustor, more particularly in a first band 61A,B located within the primary region 34 and in a second band 63A,B located in proximity of and/or within the exit duct portions 36A,B. The first band 61A,B has a hole density greater than that of the second band 63A,B, such as to provide more important effusion cooling within the primary region 34. In one particular embodiment, the hole density of the first band 61A is approximately four times that of the second band 63A for the outer liner 22A, and the hole density of the first band 61B is up to three times, and particularly approximately twice that of the second band 63B for the inner liner 22B.

The reducing density of effusion holes in a downstream direction from the primary region 34 to the combustor exit 38 emphasizes a diminishing build-up of the effusion cooling boundary layer thickness, which reduces the effect of cold turbine root and tip.

Referring to FIG. 3A, the outer liner 22A further includes an additional row 62 of dilution holes located downstream of the first row 50A of hole pairs 52A described above. This additional row 62 is located along or in proximity of the downstream portion of the primary region 34. This row 62 includes a nozzle sector dilution hole 64 for each of the fuel nozzle receiving holes 28, the corresponding nozzle sector hole 64 and nozzle receiving hole 28 being axially aligned, or, in other words, having a same circumferential position with respect to the outer liner 22A. The additional row 62 also includes a series of intermediate dilution holes 66 located between the nozzle sector dilution holes 64, with the intermediate holes 66 having a smaller diameter than that of the nozzle sector holes 64. In the embodiment shown, five (5) intermediate holes 66 are provided between adjacent nozzle sector holes 64 in a regularly circumferentially spaced apart manner, although in alternate embodiments various other configurations can be used.

The additional row 62 of dilution holes 64,66 allows for damping and reducing of the hot product temperature profile at the end of the primary region 34, such as to obtain a more desirable temperature profile at the exit of the combustor. The larger nozzle sector holes 64 enhance the effective mixing and penetration, and as such provide for a lower peak temperature.

Still referring to FIGS. 3A-3B, the outer and inner liners 22A,B also include a second row 68A,B of groups of dilution holes located within the primary region 34, downstream of the first row 50A,B. This second row 68A,B includes a series of groups, more particularly pairs 70A,B for the example shown. The dilution holes of each pair 70A,B are located on a respective side of and equidistant from an axis N of a respective one of the nozzle receiving holes 28. For the outer liner 22A of the example shown, the second row 68A of pairs 70A of dilution holes is located upstream of the additional row 62 of different sized holes described above. For the inner liner 22B of the example shown, the second row 68B pairs 70B of dilution holes is located at least substantially between the first and second bands 61B, 63B of effusion holes.

This second row 68A,B of pairs 70A,B of dilution holes improves the mixing process and can cool hot streaks that might have escaped cooling from the other dilution holes located upstream thereof.

In a particular embodiment, the cooling hole distribution of the combustor liner provides for a lower Overall Temperature Distribution Factor (OTDF) and a lower Radial Temperature Distribution Factor (RTDF), which improved hot end durability and life. In a particular embodiment, the reduction of the OTDF and RTDF is approximately up to 20% and up to 3%, respectively. In addition, the cooling hole distribution allows for low emission of combustion products such as, for example, $NO_x$, CO, UHC and smoke.

The above description is meant to be exemplary only, and one skilled in the art will recognize that changes may be made to the embodiments described without departing from the scope of the invention disclosed. For example, the invention may be provided in any suitable annular combustor configuration, either reverse flow as depicted or alternately a straight flow combustor, and is not limited to application in turbofan engines. Although the use of holes for directing air is preferred, other means for directing air into the combustion chamber for cooling, such as slits, louvers, openings which are permanently open as well as those which can be opened and closed as required, impingement or effusions cooling apertures, cooling air nozzles, and the like, may be used in place of or in addition to holes. The skilled reader will appreciate that any other suitable means for directing air into the combustion chamber for cooling may be employed. Still other modifications which fall within the scope of the present invention will be apparent to those skilled in the art, in light of a review of this disclosure, and such modifications are intended to fall within the literal scope of the appended claims.

What is claimed is:

1. A gas turbine engine combustor liner comprising a dome having a series of circumferentially spaced apart fuel nozzle receiving holes defined therethrough, the liner having an inner liner and an outer liner defining a combustion chamber therebetween, the combustion chamber having a plurality of overlap zones corresponding to an overlap of adjacent fuel cones centered on a respective receiving hole and corresponding to a fuel/air spray cone produced by a fuel nozzle received in the receiving holes, at least one of the inner and outer liners being effusion cooled and having a row of spaced apart dilution holes defined therethrough, the dilution holes being grouped in pairs of adjacent holes, the spacing between adjacent pairs being greater than a spacing between the adjacent holes of a pair, each pair being entirely located within a respective overlap zones.

2. The combustor liner as defined in claim 1, wherein the at least one of the inner and outer liners include both the inner liner and the outer liner, and the dilution holes of the pairs of the inner liner are at least substantially aligned with the dilution holes of the pairs of the outer liner.

3. The combustor liner as defined in claim 1, wherein the at least one of the inner and outer liners includes effusion holes provided in first and second annular bands, the first annular band being located upstream of the second annular band, the first annular band having a greater density of the effusion holes than the second annular band.

4. The combustor liner as defined in claim 3, wherein the hole density of the second band is at least 2 times that of the first band.

5. The combustor liner as defined in claim 3, wherein the at least one of the inner and outer liners include both the inner liner and the outer liner.

6. The combustor liner as defined in claim 1, wherein the row is a first row, the at least one of the inner and outer liners further including a second row of non equidistantly circumferentially spaced apart dilution holes defined therethrough, the second row being located downstream of the first row, the dilution holes of the second row being defined in pairs with the dilution holes of each pair being located on a respective side of and equidistant from an axis of a respective one of the nozzle receiving holes.

7. The combustor liner as defined in claim 6, wherein the at least one of the inner and outer liners includes the inner liner, the inner liner including effusion holes provided in first and second annular bands, the second annular band being located upstream of the first annular band, the second annular band having a greater density of the effusion holes than the first annular band, and the second row is located at least substantially between the first and second annular bands.

8. The combustor liner as defined in claim 1, wherein the at least one of the inner and outer liners includes the outer liner and the row is a first row, the outer liner further including a second row of dilution holes defined therethrough, the second row being defined downstream of the first row, the dilution holes of the second row including one nozzle sector hole aligned with an axis of each one of the fuel nozzle receiving holes, and a plurality of intermediate dilution holes between each pair of adjacent nozzle sector holes, the intermediate dilution holes having a diameter smaller than that of the nozzle sector holes.

9. The combustor liner as defined in claim 1, wherein a distance between adjacent dilution holes of adjacent pairs is at least 3.25 times that between adjacent dilution holes of a same pair.

10. The combustor liner as defined in claim 9, wherein the distance between adjacent dilution holes of adjacent pairs is approximately 7.5 times that between adjacent dilution holes of the same pair.

11. A gas turbine engine combustor comprising a dome end having receiving holes defined therethrough, an inner liner wall and an outer liner wall extending from the dome end and defining a combustion chamber therebetween, a fuel nozzle received in each of the receiving holes for producing a conical spray within the combustion chamber, at least one of the outer liner wall and the inner liner wall being effusion cooled and including a circumferential row of dilution holes defined therethrough, the dilution holes of the row being disposed in groups with the row being free of dilution holes between adjacent ones of the groups, each group being entirely located between adjacent ones of the receiving holes within an overlap zone of the conical sprays of the fuel nozzles.

12. The combustor as defined in claim 11, wherein the groups of dilution holes are pairs of circumferentially spaced apart dilution holes.

13. The combustor as defined in claim 11, wherein the at least one of the inner and outer liners include both the inner liner and the outer liner, and the dilution holes of the groups of the inner liner are at least substantially aligned with the dilution holes of the groups of the outer liner.

14. The combustor as defined in claim 11, wherein the at least one of the inner and outer liners includes effusion holes located within first and second annular regions defined around the combustor, the first region being located upstream of the second region, the first region having a greater density of the effusion holes than the second region.

15. The combustor as defined in claim 14, wherein the hole density of the second region is at least 2 times that of the first region.

16. The combustor as defined in claim 14, wherein the at least one of the inner and outer liners includes both the inner liner and the outer liner.

17. The combustor as defined in claim 11, wherein the row is a first row, the at least one of the inner and outer liners further including a second row of non equidistantly circumferentially spaced apart dilution holes defined therethrough, the second row being located downstream of the first row, the dilution holes of the second row being defined in pairs with the dilution holes of each pair being located on a respective side of and equidistant from an axis of a respective one of the receiving holes.

18. The combustor as defined in claim 17, wherein the at least one of the inner and outer liners includes the inner liner, the inner liner including effusion holes provided in first and second regions defined around the combustor, the first region being located upstream of the second region, the first region having a greater density of the effusion holes than the second region, and the second row is located at least substantially between the first and second regions.

19. The combustor as defined in claim 11, wherein the at least one of the inner and outer liners includes the outer liner and the row is a first row, the outer liner further including a second row of dilution holes defined therethrough, the second row being defined downstream of the first row, the dilution holes of the second row including one nozzle sector hole aligned with an axis of each one of the receiving holes, and a plurality of intermediate dilution holes between each pair of adjacent nozzle sector holes, the intermediate dilution holes having a diameter smaller than that of the nozzle sector holes.

20. The combustor liner as defined in claim 11, wherein a distance between adjacent dilution holes of adjacent groups is at least 3.25 times that between adjacent dilution holes of a same group.

21. The combustor liner as defined in claim 20, wherein the distance between adjacent dilution holes of adjacent groups is approximately 7.5 times that between adjacent dilution holes of the same group.

* * * * *